US005944178A

United States Patent [19]

Mao

[11] Patent Number: 5,944,178

[45] Date of Patent: Aug. 31, 1999

[54] SUIT HANGER SUPPORT OF LUGGAGE

[76] Inventor: Chen Shou Mao, 344 Section 1, Chung Shan Road, Taichung Hsien, Taiwan

[21] Appl. No.: 09/088,024

[22] Filed: Jun. 1, 1998

[51] Int. Cl.[6] ..... B65D 85/18

[52] U.S. Cl. ..... 206/289; 211/124; 24/535; 238/316.1

[58] Field of Search ..... 206/289, 287, 206/291, 292; 211/124; 248/316.1; 24/535

[56] References Cited

U.S. PATENT DOCUMENTS

| | | | |
|---|---|---|---|
| 4,732,270 | 3/1988 | Myers et al. | 206/289 |
| 4,769,878 | 9/1988 | Liao | 24/235 |
| 4,850,562 | 7/1989 | Mazzanti | 248/316.1 |
| 4,852,845 | 8/1989 | Lener | 248/316.1 |
| 4,858,870 | 8/1989 | Mazzanti | 248/316.1 |
| 4,880,113 | 11/1989 | Mobley | 206/287 |
| 5,400,900 | 3/1995 | Myers et al. | 206/289 |
| 5,531,335 | 7/1996 | Chen | 206/287 X |
| 5,590,765 | 1/1997 | London | 206/289 |
| 5,887,710 | 3/1999 | London et al. | 206/289 |

*Primary Examiner*—Gary E. Elkins
*Assistant Examiner*—Tri M. Mai
*Attorney, Agent, or Firm*—Harrison & Egbert

[57] ABSTRACT

An article of luggage is provided with a suit hanger support which is fastened with the inner wall of the shell of the luggage and is composed of an elastic clamping block, a top frame member, a seat frame shell, and a moving element. The elastic clamping block is provided with a clamping mouth and a plurality of cross grooves for locating a plurality of suit hangers. The top frame member is provided with a press edge, whereas the moving element is provided with an urging edge corresponding in location to the press edge of the top frame member. The moving element, the top frame member and the elastic clamping block are fastened pivotally with the seat frame shell such that the urging edge of the moving element is capable of urging the press edge of the top frame member to force the clamping mouth of the elastic clamping block to close, so as to locate and confine the suit hangers in the cross grooves of the elastic clamping block. As the press edge of the top frame member is relieved of the pressure exerting thereon, the clamping mouth of the elastic clamping block is forced by the elastic force of the elastic clamping block to remain open.

5 Claims, 4 Drawing Sheets

SUIT HANGER SUPPORT OF LUGGAGE

FIELD OF THE INVENTION

The present invention relates generally to an accessory for luggage, and more particularly to a suit hanger support for luggage.

BACKGROUND OF THE INVENTION

The conventional luggage is generally provided with a suit hanger support which is made integrally with the shell body of the luggage. The suit hanger support can not be therefore detached from the luggage in the event that the suit hanger support is not needed. In addition, the suit hanger support takes up the available holding space of the luggage and can also cause inconveniences.

SUMMARY OF THE INVENTION

The primary objective of the present invention is therefore to provide a luggage with a suit hanger support free from the drawbacks of the suit hanger support of the prior art described above.

In keeping with the principle of the present invention, the foregoing objective of the present invention is attained by a luggage suit hanger support comprising of an elastic clamping block, a top frame member, a seat frame shell, and a moving element. The suit hangers are located securely by the elastic clamping block in conjunction with the moving element. The suit hangers can be also released by the elastic clamping block when the top frame member is relieved of the pressure exerted thereon by the moving element.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
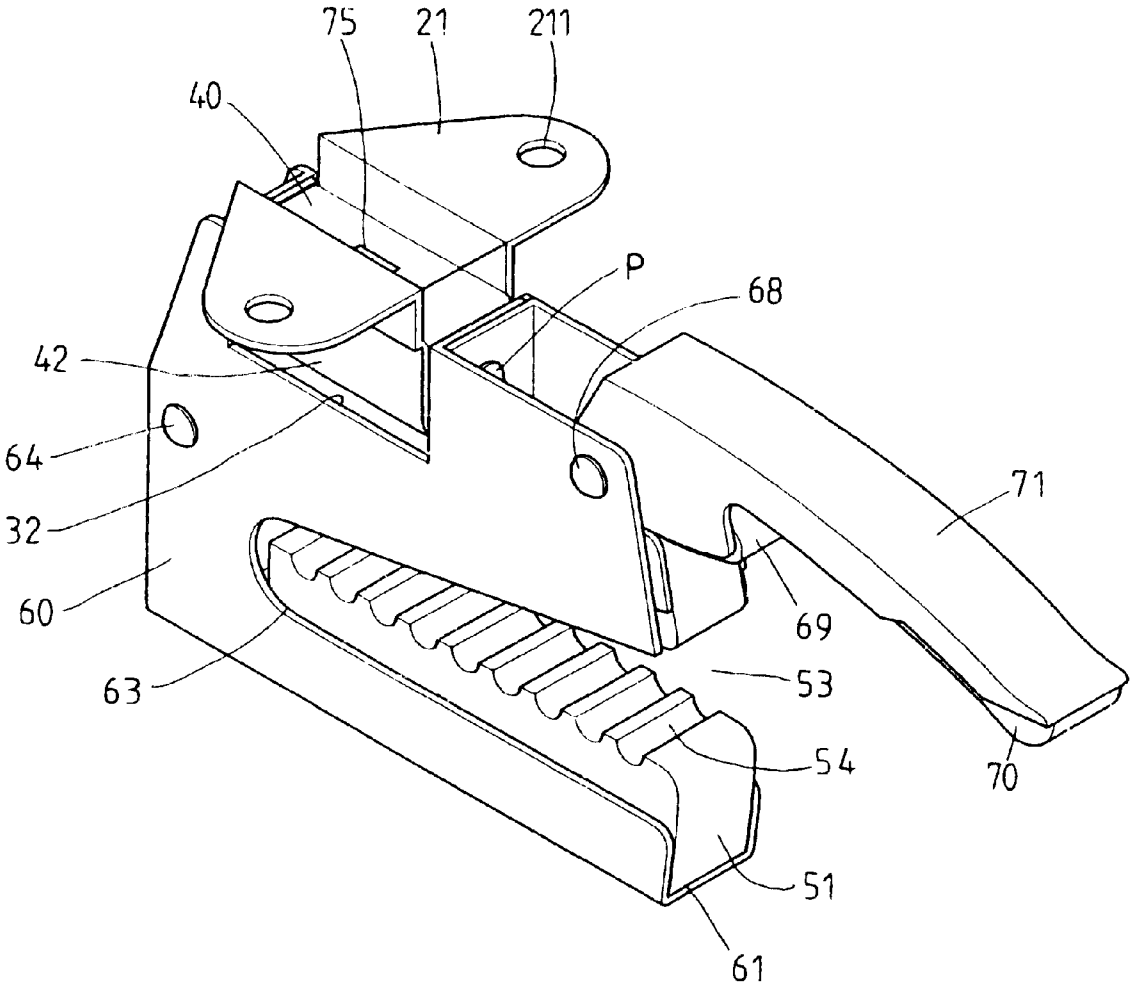
FIG. 1 shows a perspective view of the present invention.
Figure 2:
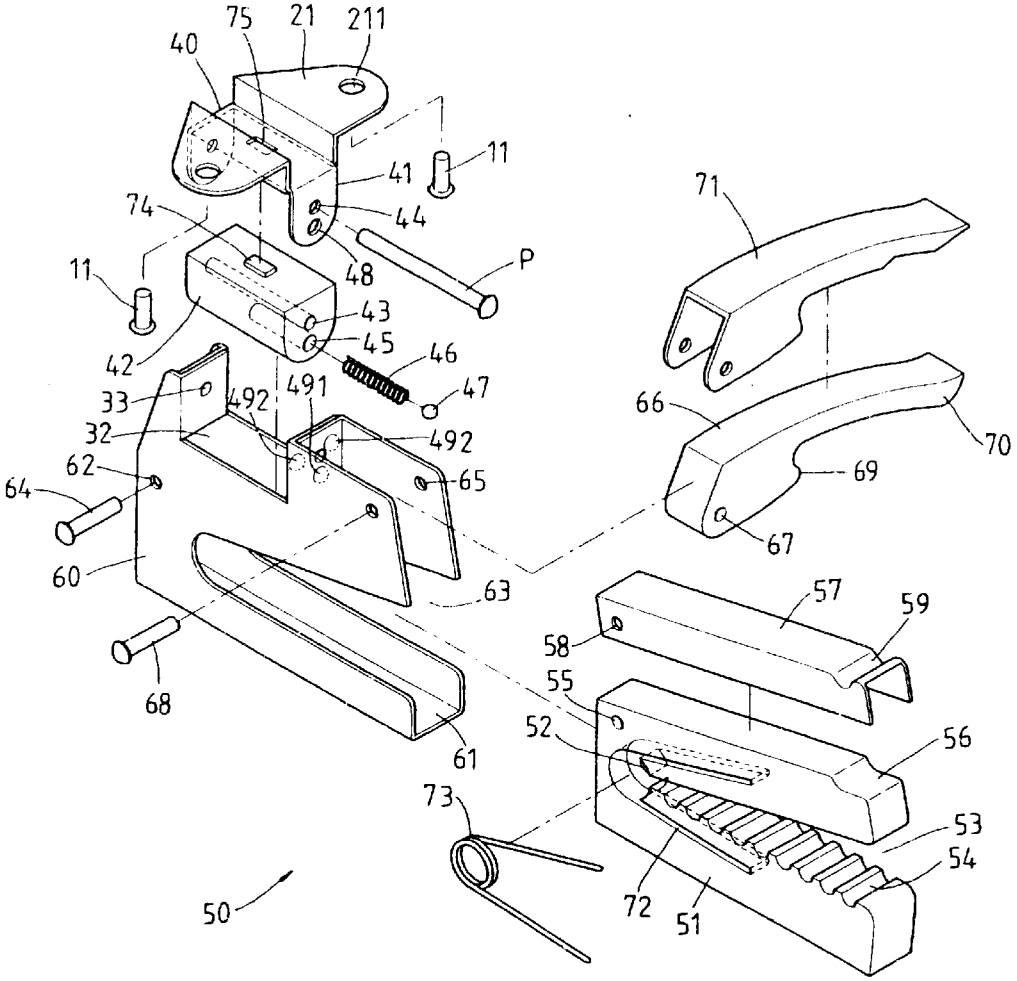
FIG. 2 shows an exploded view of the present invention.

As shown in FIGS. 1 and 2, a suit hanger support 50 embodied in the present invention is pivotally fastened with a seat body 40 by a pin P. The seat body 40 has two wings 21 provided with a hole 211. The seat body 40 is fastened with the inner wall of the luggage shell by two fastening bolts 11 which are received respectively in the hole 211 of the wing 21 of the seat body 40.

The suit hanger support 50 comprises an elastic clamping block 51, a top frame member 57, a seat frame shell 60, and a moving element 66.

The elastic clamping block 51 is provided in the center thereof with a clamping mouth 53 having an end gap 52. The elastic clamping block 51 is provided in the top of a lower arm thereof with a plurality of cross grooves 54, at one end of an upper arm thereof with a support hole 55, and at another end of the upper arm thereof with a yield edge 56.

The top frame member 57 has an inverted U-shaped cross section and is fitted over the upper arm of the elastic clamping block 51 The top frame member 57 is provided with a clamping hole 58 corresponding in location to the support hole 55 of the elastic clamping block 51. The top frame member 57 is further provided in the top edge of the front segment thereof with a press edge 59.

The seat frame shell 60 is intended to hold the elastic clamping block 51 as well as the top frame member 57. The seat frame shell 60 is provided with a receiving slot 61 for accommodating the lower arm of the elastic clamping block 51 and is further provided in the side walls thereof with a support hole 62 and a slot 63, which are respectively corresponding in location to the support hole 55 and the clamping mouth 53. A shaft 64 is received in the support hole 62 of the seat frame shell 60, the clamping hole 58 of the top frame member 57, and the support hole 55 of the elastic clamping block 51 for fastening pivotally the elastic clamping block 51 and the top frame member 57 with the seat frame shell 60. The seat frame shell 60 is further provided with a recessed seat 32 having a through hole 33 for receiving the pin P. The seat frame shell 60 is still further provided in the front segment of the upper portion thereof with two pivoting holes 65.

The moving element 66 is provided with a pivoting hole 67 for fastening pivotally the moving element 66 with the seat frame shell 60 by a pivot 68 which is received in the pivoting hole 67 and the pivoting holes 65. The moving element 66 is further provided with an urging edge 69 corresponding in location to the press edge 59 of the top frame member 57.

Figure 3:
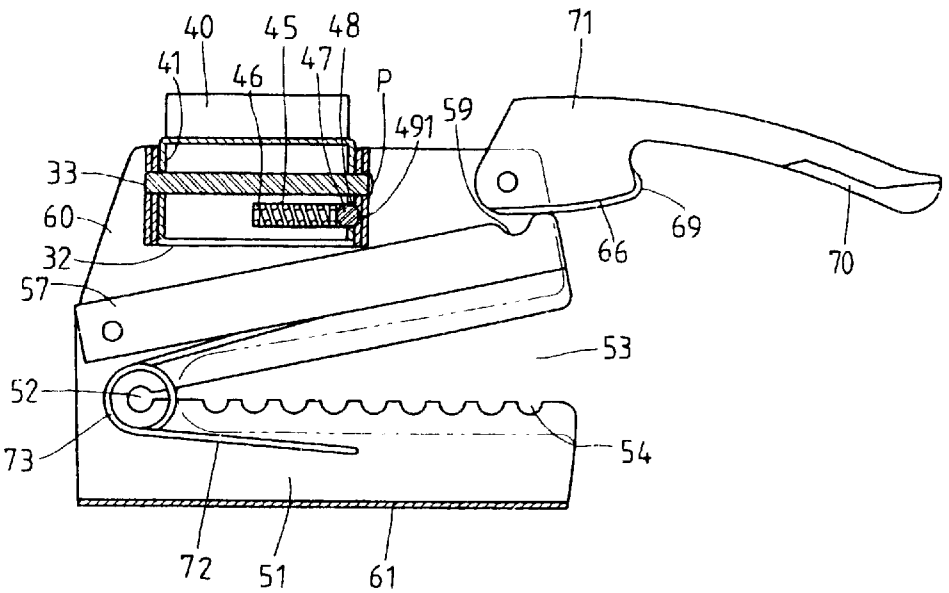
FIG. 3 shows a sectional view of the present invention in combination.
Figure 4:
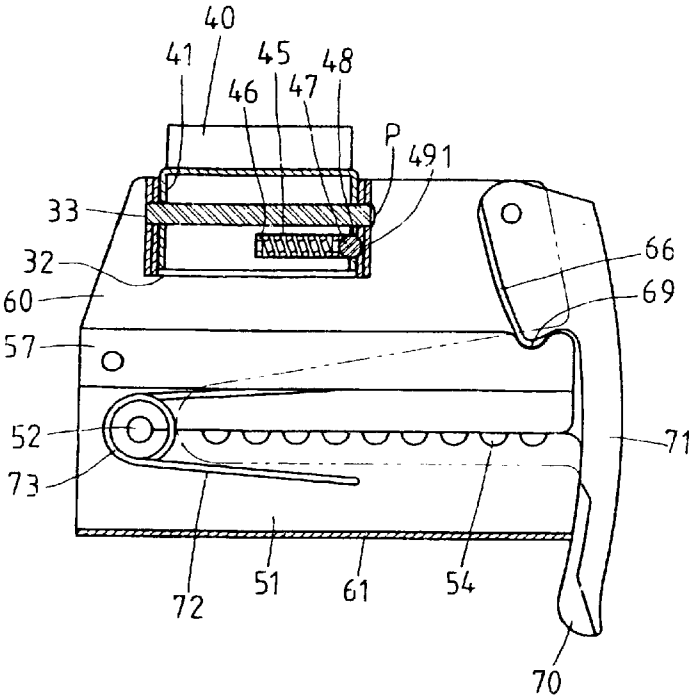
FIG. 4 shows another sectional view of the present invention in combination.

As illustrated in FIG. 4, the clamping mouth 53 of the elastic clamping block 51 is forced to close at such time when the press edge 59 of the top frame member 57 is urged by the urging edge 69 of the moving element 66. As a result, the suit hangers are securely located in the cross grooves 54 of the lower arm of the elastic clamping block 51. On the other hand, the clamping mouth 53 is forced to open by the elastic force of the elastic clamping block 51 when the pressure exerting on the press edge 59 by the urging edge 69 is relieved, as shown in FIG. 3.

Figure 5:
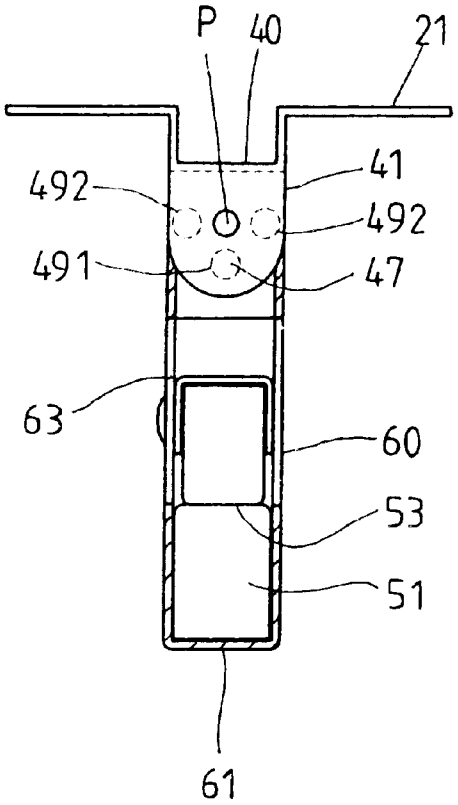
FIG. 5 shows a schematic view of the present invention in operation.
Figure 6:
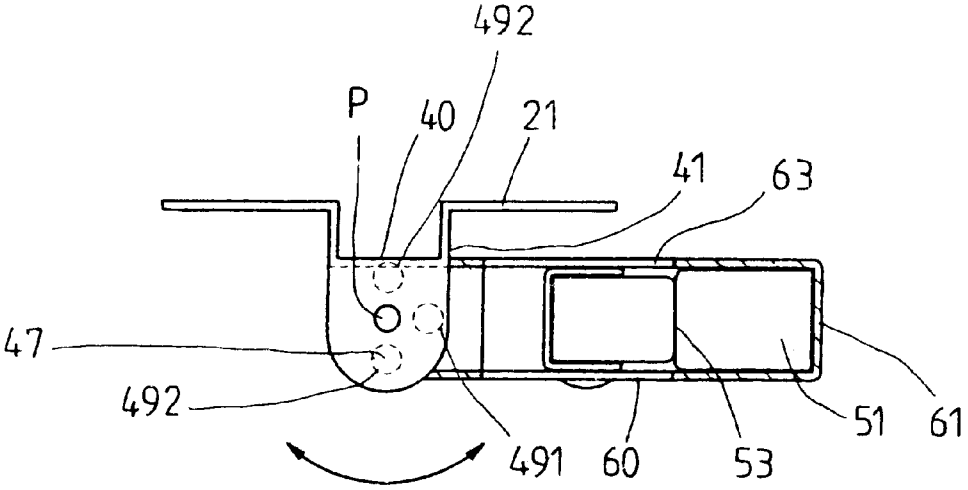
FIG. 6 Shows another schematic view of the present invention in operation.

The seat body 40 has an end plate 41 and a fastening seat 42. The end plate 41 is provided with a support hole 44, whereas the fastening seat 42 is provided with a through hole 43 corresponding in location to the support hole 44. The pin P is received in the through hole 43, the support hole 44, and the through hole 33 of the recessed seat 32. The fastening seat 42 is provided with a fitting hole 45 located under the through hole 43 and provided therein with a tension spring 46 and a ball 47 capable of passing a through hole 48 of the end plate 41, as shown in FIG. 2, in conjunction with a longitudinal locating cavity 491 and a horizontal locating cavity 492. The ball 47 is capable of locating in the longitudinal locating cavity 491 and the horizontal locating cavity 492 via the support hole 44 of the end plate 41, so as to enable the suit hanger support 50 to locate uprightly or horizontally, as shown in FIGS. 5 and 6. The moving element 66 has a handle 70 and is provided with a cover frame 71 for locating the moving element 66. The end gap 52 is provided with an extension slot 72 for locating a tension spring 73 to enhance the elasticity of the elastic clamping block 51. The fastening seat 42 is provided with a retaining block 74, whereas the seat body 40 is provided with a retaining slot 75 in which the retaining block 74 is retained so as to enhance the effect of fastening the seat body 40 with the fastening seat 42.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claims.

I claim:

1. A suit hanger support for a piece of luggage, the suit hanger support being fastened pivotally with a seat body which is fastened with an inner wall of a shell body of the luggage, the suit hanger support comprising:

an elastic clamping block having an upper arm and a lower arm forming with said upper arm a clamping mouth and an end gap opposite in location to said clamping mouth, said lower arm provided in an upper surface thereof with a plurality of cross grooves for holding a plurality of suit hangers, said upper arm provided at one end thereof with a support hole located over said end gap;

a top frame member provided with a clamping hole and fastened with said upper arm of said elastic clamping block, said top frame member further provided with a press edge;

a seat frame shell provided at one end thereof with two support holes, and at another end thereof with two pivoting holes, said elastic clamping block and said top frame member being housed in said seat frame shell such that said elastic clamping block and said top frame member are fastened with said seat frame shell by a shaft which is received in said two support holes of said seat frame shell, said support hole of said elastic clamping block and said clamping hole of said top frame member; and a moving element provided at one end thereof with a pivoting hole and fastened pivotally with said seat frame shell by a pivot which is received in said two pivoting holes of said seat frame shell and said pivoting hole of said moving element, said moving element further provided with an urging edge corresponding in location to said press edge of said top frame member, said moving element capable of moving on said pivot such that said urging edge of said moving element urges said press edge of said top frame member to force said clamping mouth of said elastic clamping block to close so as to locate and confine the suit hangers in said cross grooves, said moving element further capable of moving on said pivot such that said urging edge of said moving element moves away from said press edge of said top frame member to enable an elastic force of said elastic clamping block to force said clamping mouth to remain open.

2. The suit hanger support as defined in claim 1, wherein said seat body has an end plate provided with a fastening seat, said fastening seat provided with a fitting hole, a tension spring located in said fitting hole, and a ball located in said fitting hole; wherein said seat frame shell is provided with a longitudinal locating cavity and a horizontal locating cavity; and wherein said ball of said fastening seat is capable of being located in said longitudinal locating cavity and horizontal locating cavity so as to enable said suit hanger support to be fastened pivotally in an upright manner and in a horizontal manner.

3. The suit hanger support as defined in claim 2, wherein said fastening seat is provided with a retaining block; wherein said seat body is provided with a retaining slot; and wherein said fastening seat is fastened with said seat body such that said retaining block of said fastening seat is retained in said retaining slot of said seat body.

4. The suit hanger support as defined in claim 1, wherein said moving element is provided with a cover frame fastened therewith for locating said moving element.

5. The suit hanger support as defined in claim 1, wherein said upper arm and said lower arm of said elastic clamping block are provided with an extension slot extending from said end gap; and wherein said elastic clamping block is provided with a tension spring located in said end gap and said two extension slots for reinforcing elasticity of said elastic clamping block.

* * * * *